US012552425B2

(12) United States Patent
Wait

(10) Patent No.: US 12,552,425 B2
(45) Date of Patent: Feb. 17, 2026

(54) SYSTEMS AND METHODS FOR DEPLOYING LOCOMOTIVES WITHIN A CONSIST

(71) Applicant: Progress Rail Locomotive Inc., LaGrange, IL (US)

(72) Inventor: Keith Wesley Wait, Flower Mound, TX (US)

(73) Assignee: Progress Rail Locomotive Inc., LaGrange, IL (US)

( * ) Notice: Subject to any disclaimer, the term of this patent is extended or adjusted under 35 U.S.C. 154(b) by 110 days.

(21) Appl. No.: 18/385,814

(22) Filed: Oct. 31, 2023

(65) Prior Publication Data

US 2025/0136157 A1 May 1, 2025

(51) Int. Cl.
*B61L 15/00* (2006.01)

(52) U.S. Cl.
CPC ..... *B61L 15/0058* (2024.01); *B61L 15/0027* (2013.01)

(58) Field of Classification Search
CPC ..... B61L 15/0058; B61L 15/0027
See application file for complete search history.

(56) References Cited

U.S. PATENT DOCUMENTS 9,079,589 B2 7/2015 Cooper et al.
9,156,477 B2 10/2015 Cooper et al.
11,142,088 B2 10/2021 Deshpande et al.
11,447,164 B2 9/2022 Howard et al.
2006/0100753 A1* 5/2006 Katzer ..... A63H 19/24 701/20
2016/0129925 A1* 5/2016 Jensen ..... B61L 15/0058 701/19
2021/0070334 A1 3/2021 Howard et al.
2022/0194440 A1 6/2022 Akif et al.

FOREIGN PATENT DOCUMENTS

CN 103465799 B 11/2017
EP 3686082 A1 7/2020

OTHER PUBLICATIONS

US 8,935,021 B1, 01/2015, Kral (withdrawn)

* cited by examiner

*Primary Examiner* — Long T Tran
*Assistant Examiner* — Charles J Brauch

(57) ABSTRACT

An energy-management system of a train performs real-time assessment of operating parameters of the train and characteristics of a route using machine-learning algorithms. A consist management module within the energy-management system evaluates predictions of future performance by the train when different numbers of locomotives within a consist are inactive. Calculating and comparing operating benefits obtained from the predictions with respect to an upcoming distance, the consist management module identifies a number of locomotives to place in an isolation mode to provide efficient operation of the train. The number identified is provided to a driving strategy module for consideration in maneuvering the train over the upcoming distance.

20 Claims, 5 Drawing Sheets

SYSTEMS AND METHODS FOR DEPLOYING LOCOMOTIVES WITHIN A CONSIST

TECHNICAL FIELD

The present disclosure relates to selective deployment of locomotives within a consist for providing motive force to a train. More specifically, the present disclosure relates to an energy-management system of a train selectively activating or deactivating locomotives within a consist based on real-time operating conditions during a mission.

BACKGROUND

A group of locomotives, called a consist, can provide motive force for propelling a train along a route during a trip, or mission. A lead locomotive contains controls for managing behavior of the other locomotives in the consist via a communications network. Some locomotives may be configured to be individually addressable, such that the lead locomotive can provide independent commands using direct control following known protocols. Other locomotives in the consist may require group addressing via a trainline command.

Traditionally, the locomotives were powered equally. When a train engineer changed the throttle in the lead locomotive, throttles in each locomotive changed the same. To conserve fuel during a mission, however, control options now exist for setting throttles in locomotives separately to account for operational differences between these locomotives. With these options, when the throttle notch is selected in the lead locomotive, the throttle in each addressable locomotive may be set to an optimal position for providing the required power and tractive effort for the consist while enhancing fuel efficiency. These throttle options, however, do not typically account for the operating environment over the particular route being traversed.

Other control features in a consist may consider restrictions along a route to help improve fuel efficiency. Speed limits, slope changes, and noise or emission limits along the route and payload size and engine efficiencies within the train can all impact energy demands on the consist significantly. Therefore, an electronic control system within the train typically includes an energy-management system intended to automatically control the consist to manage fuel usage, speed, and other parameters. In one example, the energy-management system evaluates data relating to operating parameters for the train and characteristics of a route in real time using machine-learning algorithms or artificial intelligence. With this evaluation, the energy-management system can predict demands on the consist as the train progresses and modify throttle activity to enhance efficiency. These real-time systems do not, however, consider the activation or deactivation of selective locomotives within the consist during the mission in real time based on the predictive demands.

Other energy-management systems are a priori, or plan-based. The route of a mission is evaluated in advance to form a trip plan. Portions of the route may be identified where changes to a throttle algorithm should be made, whether for enhancing energy efficiency or for adjusting to the terrain or other operating conditions. When the train reaches those predetermined locations or situations along the route, the trip plan triggers changes to the tractive force, including possible activation or deactivation of certain locomotives within the consist.

One plan-based approach for activating and deactivating locomotives of a consist is described in U.S. Pat. No. 9,079,589 ("the '589 patent"). In the '589 patent, propulsion is needed from inactive, or isolated, locomotives during a trip because unexpected events have caused the train to slow in contravention to a trip plan. An energy-management system, in conjunction with an isolation-control system, sends instructions to activate at least one of the inactive locomotives to help the train accelerate to a plan speed, after which the locomotives are switched back to their isolated state. Implemented within a plan-based energy-management system, the '589 patent exemplifies the difficulties that can arise when actual situations on a route deviate from a trip plan. The '589 patent additionally does not contemplate a real-time energy-management system deploying locomotives in a consist based on predicted operating parameters of the train as it crosses an upcoming distance of a path.

Examples of the present disclosure are directed to overcoming deficiencies of such systems.

SUMMARY

In an aspect of the present disclosure, a computer-implemented method includes identifying addressable locomotives within a consist of a train, the addressable locomotives being individually addressable by a control system on the train and receiving, during movement of the train along a path, current operating parameters of the train and characteristics of the path across an upcoming distance. The method further includes predicting, based at least in part on the current operating parameters and the characteristics, baseline operational metrics for the train across the upcoming distance under a baseline condition, the baseline condition being a baseline set of the addressable locomotives will be deployed, and predicting in real time, based at least in part on the current operating parameters and the characteristics, first operational metrics for the train across the upcoming distance under a first condition, the first condition being a first set of the addressable locomotives will be deployed. A baseline benefit is calculated from the baseline operational metrics, a first benefit is calculated from the first operational metrics, and the baseline benefit with the first benefit are compared. When the first benefit exceeds the baseline benefit, the method entails selecting the first set of addressable locomotives as an updated set of addressable locomotives and causing the updated set of addressable locomotives to be deployed for the train.

In another aspect of the present disclosure, a control system for a consist of locomotives includes a consist storage module configured to store status data regarding the locomotives, the status data indicating availability of the locomotives for providing motive force along a route, a prediction module, and a consist management module. The prediction module is configured to predict in real time, based at least in part on current operating parameters of a train moving along a path and characteristics of the path across an upcoming distance, baseline operational metrics expected for the train across the upcoming distance under a baseline condition, where the baseline condition is that a group of the locomotives will be deployed. The prediction module is also configured to predict in real time, based at least in part on the current operating parameters and the characteristics, alternate operational metrics expected for the train across the upcoming distance under an alternate condition, where the alternate condition is that a subset of the group of the locomotives will be deployed. The consist management module is configured to calculate a baseline benefit from the baseline operational metrics, calculate an alternate benefit from the alternate operational metrics, and compare the baseline benefit with the alternate benefit. When the alternate benefit exceeds the baseline benefit, the consist management module assigns the subset of the group of the locomotives as an updated assignment of the locomotives and causes the updated assignment of the locomotives to be deployed for the train.

In yet another aspect of the present disclosure, a consist of locomotives for a train includes a lead locomotive containing, at least in part, a control system for the train: a first locomotive individually addressable by the control system via a communication network: a second locomotive individually addressable by the control system via the communication network; and an energy-management system, at least partially contained within control system. The energy-management system is configured to receive, during movement of the train along a path, current operating parameters of the train and characteristics of the path across an upcoming distance. The energy-management system additionally predicts in real time, based at least in part on the current operating parameters and the characteristics, baseline operational metrics for the train across the upcoming distance under a baseline condition that the first locomotive and the second locomotive will be deployed, and predicts in real time, based at least in part on the current operating parameters and the characteristics, alternate operational metrics for the train across the upcoming distance under an alternate condition that the first locomotive will be deployed and the second locomotive will not be deployed. Further, the energy-management system also calculates a baseline benefit from the baseline operational metrics, calculates an alternate benefit from the alternate operational metrics, and compares the baseline benefit with the alternate benefit. When the alternate benefit exceeds the baseline benefit, the baseline set is assigned without the second locomotive as an updated set of the locomotives. The consist also includes a locomotive control system, within at least the second locomotive, configured to cause the second locomotive to operate in an isolation mode in response to the assignment of the updated set by the energy-management system.

BRIEF DESCRIPTION OF DRAWINGS

The detailed description references the accompanying figures. In the figures, the left-most digit of a reference number identifies the figure in which the reference number first appears. The same reference numbers indicate similar or identical items.

DETAILED DESCRIPTION

Consistent with the principles of the present disclosure, an energy-management system and method for deploying locomotives within a consist of a train provides enhanced efficiency for running a train across an upcoming distance along a route. The energy-management system assesses in real time the operating parameters of the train and characteristics of the route using machine-learning algorithms. Portions of the energy-management system predict, based at least in part on the current operating parameters and the route characteristics, baseline operational metrics for the train across the upcoming distance under a baseline condition that a baseline set of locomotives will be deployed. The system also predicts in real time, based at least in part on the current operating parameters and the route characteristics, different operational metrics for operation of the train under a condition that a different set of locomotives will be deployed. From those predictions, a consist management module calculates a baseline benefit when the baseline set of locomotives are deployed and a value of the benefit when the different set of locomotives are deployed. The consist management module compares these operating benefits of the train derived from the predictions and identifies a number of locomotives to place in an isolation mode to provide efficient operation of the train. The number identified is provided to a driving strategy module for consideration in maneuvering the train over the upcoming distance. The following describes several examples for carrying out the principles of this disclosure.

Figure 1A:
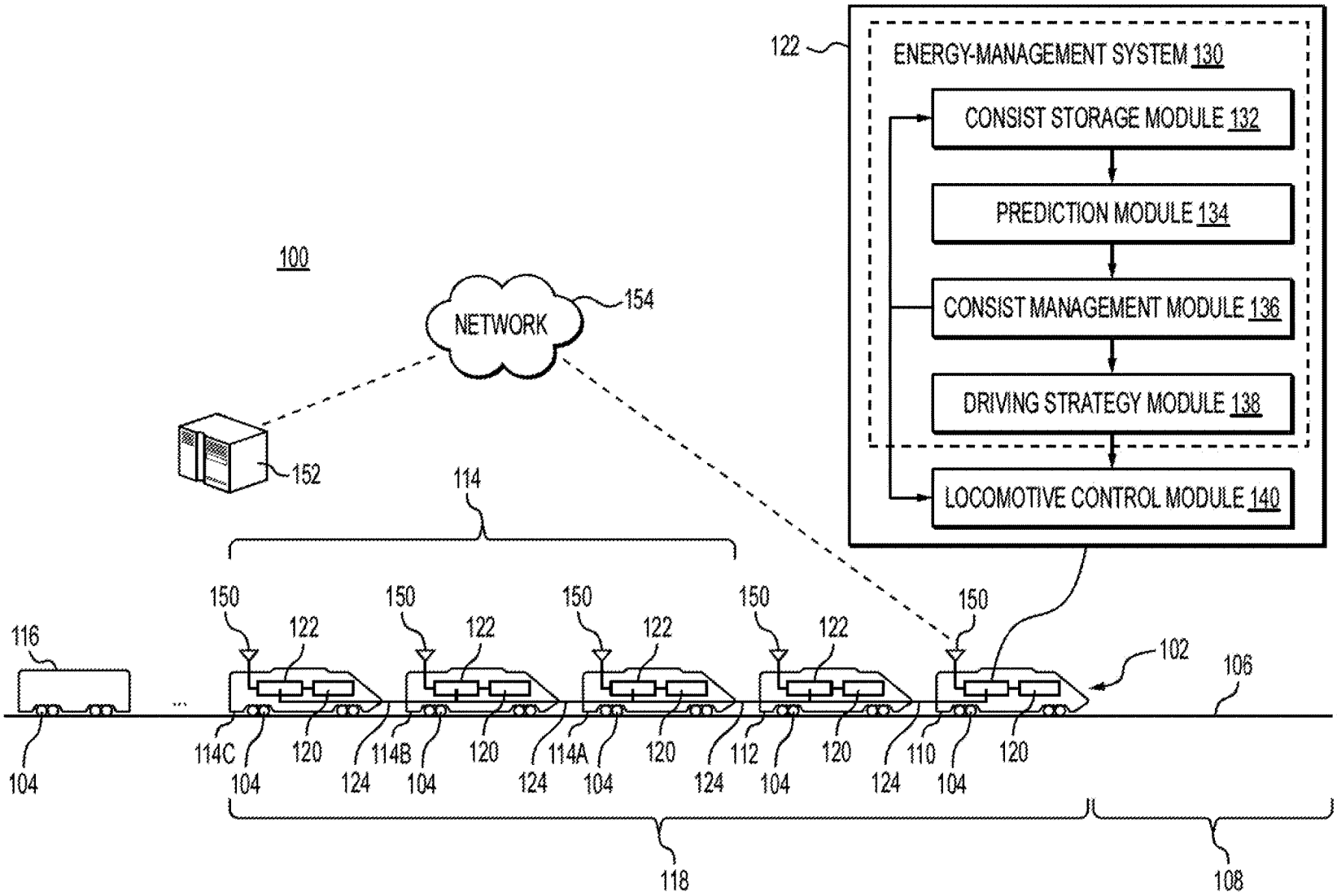
FIG. 1A is a schematic diagram of a train system in accordance with an example of the present disclosure.

FIG. 1A is a schematic diagram of a train system 100 for controlling deployment of locomotives within a consist as one example suitable for carrying out the principles discussed in the present disclosure. Exemplary train 102 functions as a rail vehicle and travels on wheels 104 along route 106 from a source to a destination (from left to right in FIG. 1A). As train 102 travels along route 106, an upcoming distance 108 extends in front of the train. Discussed in more detail below, upcoming distance 108 may be up to several kilometers in length and moves forward along route 106 as train 102 progresses.

Train 102 includes several rail cars or units, which are either powered units or non-powered units, linked together. "Powered units" refers to rail cars that are capable of self-propulsion, such as locomotives. "Nonpowered units" refers to rail cars that are incapable of self-propulsion, but which may otherwise receive electric power for other services, such as freight cars or passenger cars. In FIG. 1A, train 102 includes powered units at least in the form of lead locomotive 110, nonaddressable locomotive 112, and addressable locomotives 114, along with nonpowered unit 116. This arrangement is exemplary. Fewer powered units may be present, or additional powered units and nonpowered units of any variety may be included in train 102. For instance, while the powered units in FIG. 1A are arranged in a consist 118, additional consists may be present at other locations within train 102. Further, the rail cars may be arranged in any order within train 102 without departing from the principles of this disclosure.

The lead locomotive 110 serves as a center for management and control for other powered units. The term "lead" in lead locomotive 110 refers in this context to a powered unit that is designated for primary control of other locomotives within consist 118. While illustrated at the front of train 102, lead locomotive 110 may be located at any position. A propulsion system 120 within lead locomotive 110 provides power for delivering tractive effort to help cause train 102 to move along wheels 104 as well as braking effort to reduce or stop the movement. Propulsion system 120 includes electric and/or mechanical devices and components, such as diesel or electric engines, electric generators, and traction motors, used to provide tractive effort that propels train 102. Braking effort may arise from dynamic braking, rheostatic braking, frictional braking, or other means in conjunction with propulsion system 120 as known to those of ordinary skill in the field.

The powered units within consist 118 other than lead locomotive 110 may be referred to as trailing units or trailing locomotives. Consist 118 of FIG. 1A includes four interconnected, trailing locomotives besides lead locomotive 110. In this context, "trailing" refers to powered units that are under at least partial control of lead locomotive 110 and does not necessarily reflect positioning of the powered units within consist 118 or within train 102. These trailing powered units are mechanically coupled or linked to each other and to lead locomotive 110, to travel along route 106. For instance, in FIG. 1A, a nonaddressable locomotive 112 is immediately behind lead locomotive 110, followed by three addressable locomotives 114. The order of these locomotives with consist 118 may be different than is shown, and nonpowered units may be placed between the powered units. The trailing locomotives, such as nonaddressable locomotive 112 and addressable locomotives 114, each have a propulsion system 120 as with lead locomotive 110 for providing tractive and braking effort for assisting in movement of train 102.

Additionally, the powered locomotives within consist 118 include at least some portion or form of control system 122 for electronically monitoring, managing, controlling, or executing various operations within consist 118. Typically, lead locomotive 110 contains a control system 122, whether implemented as a discrete control system within that lead locomotive or a portion of a collective control system distributed across each locomotive in consist 118, that acts as a central controller for operations within itself and the other locomotives within consist 118. In some examples, control system 122 resides at least within lead locomotive 110 within an onboard controller and embodies one or more computer processors that include a means for operating and/or controlling train 102 based on information obtained from sensors monitoring various train components, from data stored in memory, from communications received external to the locomotive, and other sources. Control system 122 may include computer-readable media in the form of a memory, a secondary storage device, a processor, and any other components for executing instructions stored on the computer-readable media. The memory may include a non-transitory computer-readable medium, such as RAM, ROM, FLASH memory, CD ROM, magnetic devices (e.g., disks, tape, etc.), and/or other types of memory. Various other circuits may be associated with a controller such as power supply circuitry, signal conditioning circuitry, solenoid driver circuitry, and other types of circuitry. Different modules and functions of control system 122 are discussed in more detail below.

Train 102 also includes communication system 150 at least for wirelessly transmitting and receiving electrical signals with offboard remote electronics external to the train. communication system 150 is communicatively coupled with control system 122 in at least one or more of the powered locomotives and includes one or more antennas for facilitating wireless communication. Communication system 150 may include electronic components for facilitating communication within a railroad network under protocols and standards known to those of ordinary skill in the field. Examples include a cellular connection following TDMA, 3G, 4G, 5G, or other protocol, a wireless local area network (WLAN), WiMax (Worldwide Interoperability for Microwave Access), satellite communications, and the like. In one example, communication system 150 connects wirelessly with a back-office system 152, which may include mainframe computers and other storage devices for housing information relevant to the operation, routing, and scheduling of train 102 along route 106.

As depicted in FIG. 1A, communication system 150 facilitates wireless communications between train 102 and a railyard back-office system 152, a remotely located server, a third-party server, and the like, via a wireless network 154. The back-office system 152 may include a computer system configured for planning, monitoring, and adjusting schedules and movement of trains within a railroad network. The back-office system 152 may be in continuous or intermittent communication with communication system 150 on train 102 before and during movement of the train along route 106.

In some examples, communication system 150 in conjunction with control system 122 coordinates operations of various components and subsystems, such as propulsion system 120 within each of the powered units of consist 118. The communication system 150 within lead locomotive 110 may be referred to as a lead communication unit that initiates a message to back-office system 152 containing information on an operational state of lead locomotive 110, such as a throttle setting, a brake setting, readiness for dynamic braking, the tripping of a circuit breaker, or other operational characteristics. Communication system 150 within lead locomotive 110 may communicate with the communication system 150 within other powered units of consist 118, which are interconnected via a network connection 124. In one example, network connection 124 includes a net port and jumper cable that extends along train 102 and between each control system 122 of the powered units. The network connection 124 may be a multiple unit cable (MU cable), an Electrically Controlled Pneumatic brake line (ECPB), a fiber optic cable, other cable configuration, or a wireless connection. Similarly, network connection 124 may connect and communicatively couple propulsion system 120 of the locomotives in consist 118. High speed communication networks may be employed in consist 118 using a common ethernet communication bus. The ethernet communication signals may be superimposed over other digital communication signals carried by some of the wires in MU cables. MU cables provide trainline communications between the locomotives in a consist, including operational commands such as throttle control settings. The networking standard employed in the consist may include an inter-consist communication (ICC) router and an ethernet bridge device on each car.

In some examples, network connection 124 includes several channels over which network data is communicated with each channel representing a different pathway for network data. In some examples, one or more channels within network connection 124 may communicate a trainline command accessible by all rail cars within train 102. In this situation, the information conveyed within the trainline command is general to all rail cars and is generally not specific to a particular locomotive. In other examples, control system 122 within one or more of the locomotives, such as addressable locomotives 114 within consist 118, have the capacity to be directly and uniquely addressed by lead locomotive 110. For instance, control system 122 within addressable locomotives 114 may abide by LCCM protocols and enable direct communication from control system 122 in lead locomotive 110. On the other hand, some powered units in train 102, such as nonaddressable locomotive 112, may not have the capacity to be directly addressed by lead locomotive 110 and must rely on trainline communications. These communication options are provided as examples and are not limiting to the present disclosure. Various options for communicating between railcars are available and within the knowledge of those of ordinary skill in the field.

As embodied within lead locomotive 110, control system 122 also includes an automatic train operation (ATO) system that has an energy-management system 130 embedded within or in electronic communication at least with propulsion system 120. Energy-management system 130 is an automated module or software engine within control system 122 configured to generate command signals to optimize control of train 102 under currently detected circumstances. In this context, a module or engine refers to hardware, software, or combinations of hardware and software configured to store and execute computer-readable instructions for a particular task. Control system 122 may be configured to receive input signals from a variety of sensors and other inputs indicative of operating parameters of the train and to generate output signals for achieving optimum control of the train. The automated energy management system may be configured to make these output signals or requests based on a variety of measured operational parameters, track conditions, freight loads, trip plans, and predetermined maps or other stored data with a goal of improving availability, safety, timeliness, overall fuel economy and emissions output for the entire train. For example, energy-management system 130 may generate command signals for automatically controlling throttle, braking, and or other aspects of train 102 associated with propulsion system 120 based on the current operating parameters and health condition of the locomotive, along with the current mission, location, and topography, in order to achieve optimum performance while accomplishing mission goals and objectives. Mission goals and objectives may include achieving performance goals (e.g., performance levels, efficiency levels, etc.), adhering to schedules, and obeying laws (e.g., speed limits). The energy-management system may also control or modify operating parameters for train 102 to maximize fuel efficiency and/or to minimize emissions. As discussed further below, decisions and command signals generated within energy-management system 130 may involve and be shared with other locomotives within consist 118.

As indicated in FIG. 1A, energy-management system 130) includes several modules or engines embedded within its operation. For instance, consist storage module 132 functions as a repository of data and configurations for the locomotives within consist 118 for the particular train 102. Consist storage module 132 may include an identification of capabilities and a channel mapping for the locomotives to assist lead locomotive 110 in signaling and deploying the locomotives as required. In some examples, consist storage module 132 obtains at least some of the information relating to the locomotives within consist 118 from back-office system 152. In other examples, a control system 122 within a locomotive includes software, such as an IC Routing Application, that discovers the existence of other locomotives on a trainline network for use by consist storage module 132. The capability and channel mapping may include information about which of the locomotives may comply with LCCM protocols and be directly addressable by lead locomotive 110, i.e., addressable locomotives 114. As a result, consist storage module 132 within control system 122 can conclude that first addressable locomotive 114A, second addressable locomotive 114B, and third addressable locomotive 114C can be directly addressed and controlled via network connection 124 independently of other locomotives in consist 118. Conversely, consist storage module 132 may include information relating to the non-addressability by lead locomotive 110 of locomotives within consist 118, i.e., nonaddressable locomotive 112. Lead locomotive 110 can then conclude that nonaddressable locomotive 112 may only be controlled via a common trainline and not uniquely among the trailing locomotives.

In some examples, energy-management system 130 also includes a prediction module 134, which is a machine-learning modeling engine configured to create one or more models of train operation in a variety of conditions. The machine-learning modeling engine may be based on training data focused on historical operational data acquired by various sensors associated with one or more locomotives during actual train runs. The sensors may include brake temperature sensors, exhaust sensors, fuel level sensors, pressure sensors, knock sensors, reductant level or temperature sensors, generator power output sensors, voltage or current sensors, speed sensors, motion detection sensors, location sensors, wheel temperature or bearing temperature sensors, or any other sensor known in the art for monitoring various train operational parameters.

During historical runs of train 102 or similar trains over a variety of conditions, i.e., different grades, speeds, climates, payloads, fuels, locomotives, etc., the sensors (not shown) provide operational data that is fed as training data to prediction module 134. The operational data can include a state of a particular locomotive in a consist, a representation or state of an environment surrounding the consist, including behavior of other trains or locomotives on the same or interconnected tracks in the same geographical area, and commands, instructions, or other communications received from other entities. The training data may also include data indicative of actions taken by a train operator, or directly or indirectly resulting from actions taken by the train operator, under a large variety of operating conditions, and on trains with the same or different equipment, different operational characteristics, and different parameters. For example, a learning system according to prediction module 134 can be trained to learn how a train such as train 102 and experienced human engineers respond to different inputs under various operating conditions, such as during the automatic implementation of train control commands by trip optimizer programs, positive train control (PTC) algorithms, and automatic train operations (ATO), during extreme weather conditions, during emergency conditions caused by other train traffic or equipment failure on the train, while approaching and maneuvering in train yards, and under other train operating conditions. The methods and algorithms for training a learning system such as prediction module 134 with historical operational data fed from sensors during actual runs of a train such as train 102 are within the knowledge of those of ordinary skill in the art.

Figure 1B:
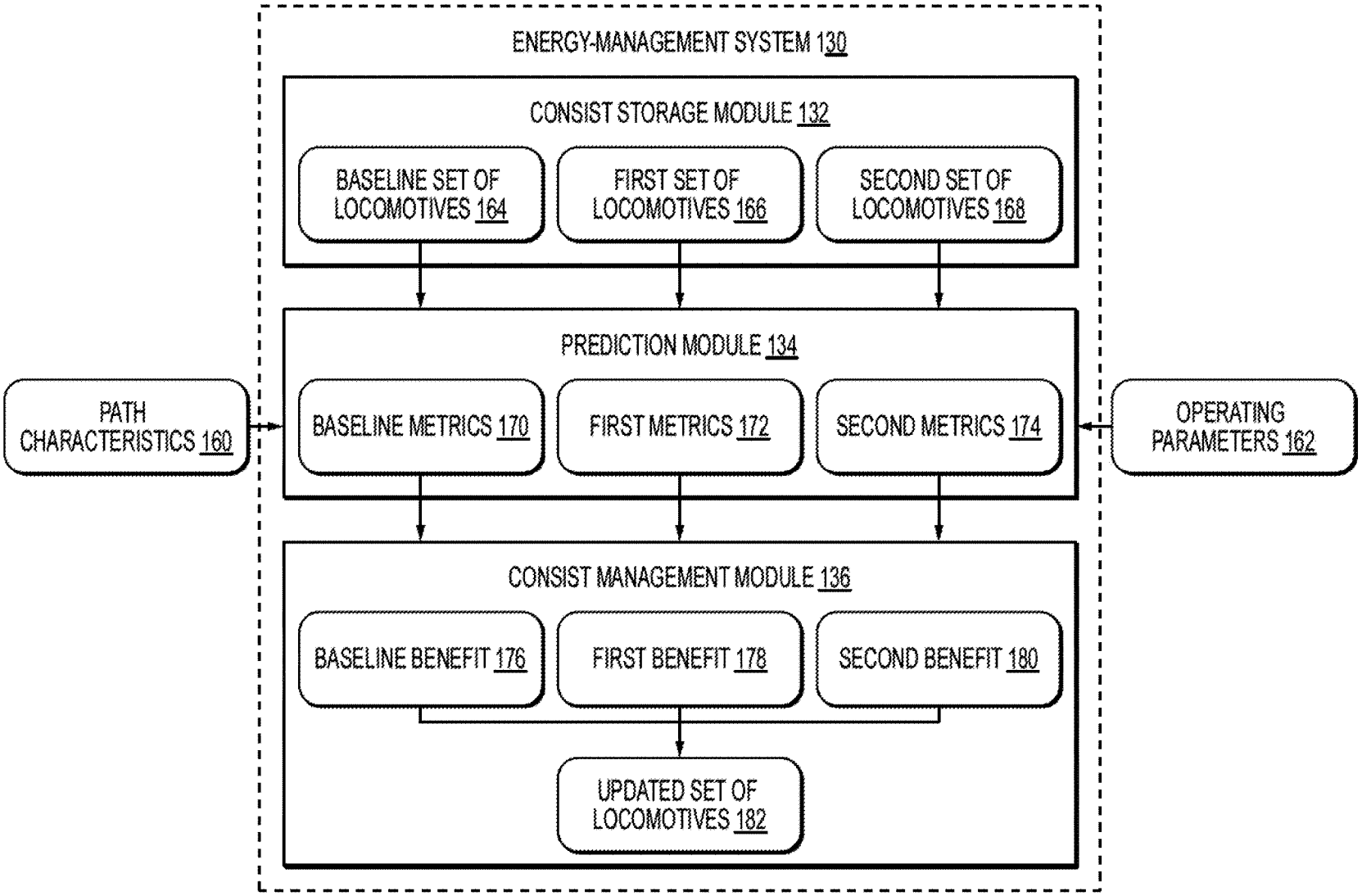
FIG. 1B is a block diagram of data flow within an energy-management system of the train system of FIG. 1A in accordance with an example of the present disclosure.

Using its trained learning system, prediction module 134 within energy-management system 130 can be configured to generate predicted data for operation of train 102. FIG. 1B is a block diagram showing a flow of representative data between various modules of energy-management system 130, including prediction module 134. As generally shown in FIG. 1B, prediction module 134 may predict, based on its machine-learning algorithm having processed historical data from previous runs, operational metrics for future movement of a train in accordance with characteristics of a path to be traversed. These metrics in the example of FIG. 1B may include baseline metrics 170, first metrics 172, and second metrics 174. In this regard, prediction module 134 may be configured to receive data indicative of characteristics of a path to be traversed by train 102 in a short time in the future, namely, path characteristics 160. For FIG. 1A, as train 102 travels from left to right along route 106, upcoming distance 108 may contain certain characteristics relevant to operation of train 102. These path characteristics 160 may include, for instance, a slope or grade, curvature, and speed limit along upcoming distance 108. In addition, prediction module 134 may receive data relating to an environment around upcoming distance 108 through which train 102 will soon pass, such as wind speed, wind direction, precipitation, emissions requirements, or noise limitations. These path characteristics 160 for upcoming distance 108 to be traversed by train 102 may be received by lead locomotive 110 via back-office system 152 as provided through a railway system or through other sensors or sources provided along route 106 and collected by communication system 150 of train 102. Alternatively, path characteristics 160 may be collected and stored in consist storage module 132 or other modules within energy-management system 130 as desired.

In coordination with path characteristics 160 such as for upcoming distance 108 for train 102, prediction module 134 may also be configured to receive certain "real-time" operating parameters of the train, namely, operating parameters 162. "Real time" in this context, generally means concurrently with train 102 traveling along route 106 and approaching upcoming distance 108. Real-time path characteristics 160 of the train include any sensed or measured parameter relating to the functioning of train 102 along upcoming distance 108, which may include data from at least the same sensors considered in building the learning system within prediction module 134. That is, the sensors and their associated measured parameters may include brake temperature sensors, exhaust sensors, fuel level sensors, pressure sensors, knock sensors, reductant level or temperature sensors, generator power output sensors, voltage or current sensors, speed sensors, motion detection sensors, location sensors, wheel temperature or bearing temperature sensors, or any other sensor known in the art for monitoring various train operational parameters. Using real-time operating parameters 162 of train 102, prediction module 134 may consider the current situation for the trip, which will tend to correlate to the future parameters when traversing upcoming distance 108 of a few miles. Thus, sensed operating parameters 162 of fuel level, speed, emissions, power output, etc. for a current or real-time situation for the particular locomotives and payload in train 102 may provide a starting point for prediction module 134 for predictive analysis of the behavior of consist 118 and train 102 in the future along upcoming distance 108.

Among the computations performable within energy-management system 130, prediction module 134 may evaluate future operational metrics for train 102 based on a varying number and identity of addressable locomotives 114 being active. In this context, being active or activated refers to the locomotive providing at least some tractive effort for train 102. In contrast, being inactive or deactivated refers to the locomotive operating in an isolation mode or in an idle condition where tractive effort is not provided for train 102. Thus, while consist 118 may have a plurality of addressable locomotives 114, such as the three depicted in the example of FIG. 1A, any one or more of the addressable locomotives 114 may be taken offline or placed in an inactive condition as needed to conserve energy, emissions, noise, for example. In some examples, prediction module 134 predicts operational metrics for train 102 at a future time while traveling along upcoming distance 108 for any combination of addressable locomotives 114 being active within consist 118, such as all of addressable locomotives 114 being active, only first addressable locomotive 114A and second addressable locomotive 114B being active, only first addressable locomotive 114A and third addressable locomotive 114C being active, only second addressable locomotive 114B being active, etc. The prediction of operational metrics for train 102 in these situations may be informed by the path characteristics 160 along upcoming distance 108 received by communication system 150 and control system 122, the real-time operating parameters 162 of the train, and the historical data processed through the machine-learning system within prediction module 134.

Referring to FIG. 1B, consist storage module 132 may derive from addressable locomotives 114 a variety of sets of addressable locomotives to be analyzed by prediction module 134. In one example, a baseline set of locomotives 164 entails a current set of active and addressable locomotives within consist 118. For train 102 in FIG. 1, baseline set of locomotives 164 could be a set including first addressable locomotive 114A and second addressable locomotive 114B, for instance. Additionally, consist storage module 132 may derive a first set of locomotives 166 from addressable locomotives 114 that deactivates one of the locomotives from baseline set of locomotives 164. As a result, first set of locomotives 166 could include first addressable locomotive 114A or second addressable locomotive 114B operating alone, along with lead locomotive 110 and nonaddressable locomotive 112. As well, consist storage module 132 may derive a second set of locomotives 168 that activates another locomotive to add to baseline set of locomotives 164, such that second set of locomotives 168 may contain first addressable locomotive 114A, second addressable locomotive 114B, and third addressable locomotive 114C, along with lead locomotive 110 and nonaddressable locomotive 112. Beyond identifying the different potential groups of locomotives for deployment in train 102, consist storage module 132 may provide various specifications and characteristics for those locomotives to prediction module 134 for analysis.

Receiving different potential sets of locomotives, prediction module 134 in some examples evaluates those different sets using its learning machine with historical data, path characteristics 160, and operating parameters 162 to predict future operational metrics. In particular, prediction module 134 may calculate baseline metrics 170 for the baseline set of locomotives 164, first metrics 172 for the first set of locomotives 166, and second metrics 174 for the second set of locomotives 168. As discussed above, these operational metrics may indicate a wide variety of features for consist 118 and train 102, such as fuel usage, fuel amount, energy consumption, exhaust emissions, engine temperature, engine diagnostics, train speed, noise emissions, among others.

In accordance with the principles of the present disclosure, energy-management system 130 additionally includes a consist management module 136 configured to manage deployment of selected ones of the locomotives within consist 118. Typically, energy-management system 130 is hardware, software, or combinations of hardware and software configured to store and execute computer-readable instructions for determining a number of locomotives within consist 118 to activate or deactivate based on the processing of prediction module 134. In general, consist management module 136 receives results of prediction analysis from prediction module 134, such as baseline metrics 170, first metrics 172, and second metrics 174 predicted for train 102 along upcoming distance 108, and analyzes and compares the results. The analysis and comparison can entail any basis or mathematical function appropriate for the situation. In some examples, consist management module 136 may compare results of baseline metrics 170 for baseline set of locomotives 164 derived by prediction module 134 with first metrics 172 for first set of locomotives 166, or baseline metrics 170 may be compared with second metrics 174 for second set of locomotives 168 derived by prediction module 134. Consist management module 136 may be configured to identify from the comparison whether baseline set of locomotives 164, first set of locomotives 166, or second set of locomotives 168 provides more benefit to operation of train 102, represented respectively by baseline benefit 176, first benefit 178, and second benefit 180. The benefit may be any operational parameter deemed significant to operation of train 102, typically to provide energy efficiency, such as fuel savings, decreased emissions, or lower noise, as discussed further below with respect to FIGS. 2 and 3.

Figure 2:
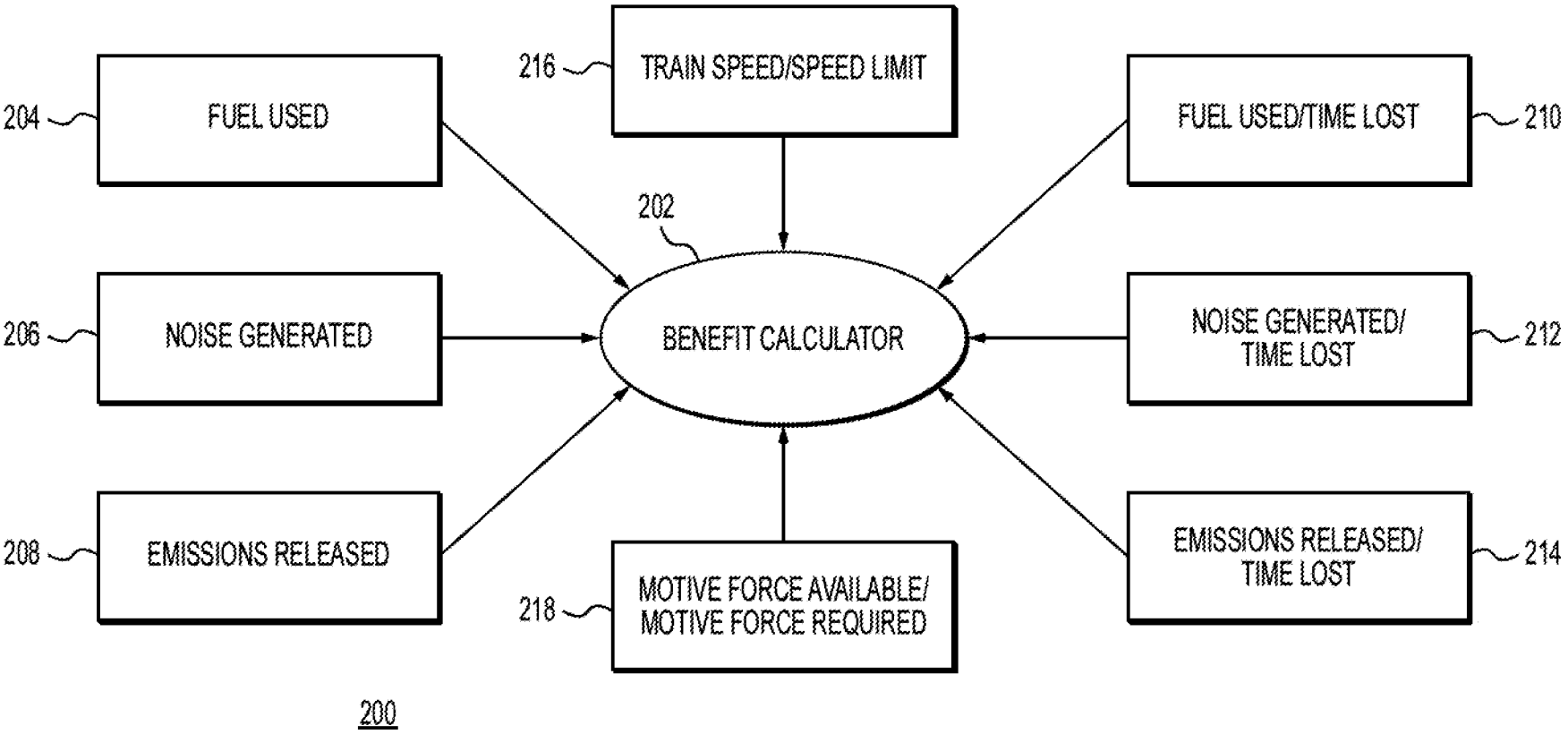
FIG. 2 is a block diagram of a benefits calculator within the energy-management system in FIG. 1 in accordance with an example of the present disclosure.

To provide further detail with respect to calculating a benefit of deploying certain ones of addressable locomotives 114, FIG. 2 is a block diagram 200 associated with a benefit calculator 202 as part of consist management module 136 for train 102. Benefit calculator 202 is a module or engine within consist management module 136 that is configured to compare, contrast, or evaluate predictive results from prediction module 134 for operational metrics of train 102 with consist 118 having different configurations of addressable locomotives 114 being activated. In some examples, benefit calculator 202 may consider one or more operational metrics generated by prediction module 134 for future travel along upcoming distance 108, such as fuel used 204, noise generated 206, or emissions released 208. As a result, benefit calculator 202 may consider which of baseline set of locomotives 164, first set of locomotives 166, or second set of locomotives 168 will provide more beneficial operation of train 102 going forward. Thus, if baseline set of locomotives 164 were predicted to lead to a lower value for fuel used 204 than first set of locomotives 166 or second set of locomotives 168 (i.e., provide a greater value for baseline benefit 176 than for first benefit 178 or second benefit 180), then benefit calculator 202 may conclude that consist 118 should be configured to remain with baseline set of locomotives 164. As a result, first addressable locomotive 114A and second addressable locomotive 114B would be configured to remain active within consist 118, such that updated set of locomotives 182 remains as baseline set of locomotives 164. However, if consist management module 136 determined that first benefit 178 exceeded baseline benefit 176, then lead locomotive 110 could communicate that first addressable locomotive 114A or second addressable locomotive 114B should enter an isolation mode or an idle state going into upcoming distance 108, such that first set of locomotives 166 becomes the updated set of locomotives 182. Benefit calculator 202 can engage in similar assessments for second benefit 180 and second set of locomotives 168.

As indicated in FIG. 2, in some examples, the comparison or evaluation conducted by benefit calculator 202 considers a cost-benefit ratio of operational parameters within train 102 over upcoming distance 108 as estimated by prediction module 134. For instance, benefit calculator 202 within consist management module 136 can consider a fuel/time ratio 210, i.e., a ratio of an amount of fuel used (a benefit) to an amount of travel time lost (a cost) by adopting a particular configuration of addressable locomotives 114 in an activated state. The cost-benefit ratio considers the fact that adjusting the deployment of addressable locomotives 114 to maximize a benefit may lead to a heightened cost, such that a balance of the benefit and cost may be a better option for prediction module 134. Specifically, deactivating more locomotives may help decrease the fuel consumed across upcoming distance 108, but significant travel time could be lost due the decrease in motive force. Comparing a cost-benefit ratio of predicted operational parameters between different configurations of addressable locomotives 114 may provide enhanced assessment of how to best deploy locomotives for train 102 during a mission.

Similarly, as shown in FIG. 2, benefit calculator 202 may consider, for example, noise/time ratio 212, emissions/time ratio 214, and/or time/speed ratio 216 in evaluating results from prediction module 134. The noise/time ratio 212, emissions/time ratio 214, and time/speed ratio 216 are similar in that they consider the benefits from decreasing tractive effort by taking one or more locomotives offline against travel time that will be lost as a result. For time/speed ratio 216, benefit calculator 202 considers how to increase train speed to a point that it does not exceed a speed limit for upcoming distance 108. Thus, if any of these ratios tends to be increasing across upcoming distance 108 as compared with a current or real-time situation for train 102, decreasing a number of active locomotives, or placing one or more of addressable locomotives 114 into isolation mode, may be an option. If any of the ratios tends to be decreasing, then increasing a number of active locomotives, or taking one or more of addressable locomotives 114 out of isolation mode, may be an option. Moreover, consist management module 136 may select the configuration of addressable locomotives 114 yielding the most desired ratio under the situation.

In another example, benefit calculator 202 may consider a force available/required ratio 218, which is a ratio of the amount of motive force available from a particular configuration of addressable locomotives 114 to an amount of motive force required to maintain speed approximate to the permitted speed limit through upcoming distance 108. The amount of motive force available from a configuration may be viewed as a force fraction, i.e., a fraction of the total motive force possible from addressable locomotives 114 that the particular configuration may provide. Therefore, if train 102 has a consist 118 with lead locomotive 110, nonaddressable locomotive 112, first addressable locomotive 114A, second addressable locomotive 114B, and third addressable locomotive 114C providing train system with 100% of the collective motive force, and each of the locomotives is capable of providing 20% of the collective motive force, then a configuration of addressable locomotive 114A and addressable locomotive 114C would have a force fraction of (20+20) for the addressable locomotives 114 and (20+20) for lead locomotive 110 and nonaddressable locomotive 112, i.e., 0.8 or 80%. Consequently, if consist 118 only needs to provide 70% of its capacity to maintain the speed limit through upcoming distance 108, then force available/required ratio 218 might be 0.8/0.7, and consist management module 136 might conclude that at least two of addressable locomotives 114 maybe pulled into an isolation state to operate through upcoming distance 108 most efficiently. Other variations of force available/required ratio 218 for evaluating an excess or lack of motive force will be apparent from this discussion to those of ordinary skill in the art.

As shown in FIG. 1A, energy-management system 130 includes a driving strategy module 138 configured to control throttling and other driving mechanisms at least in part in response to the locomotives deployed for consist 118, such as indicated in updated set of locomotives 182 of FIG. 1B. Driving strategy module 138 may also be a machine-learning model trained on historical data to help determine an optimal series of controls and maneuvers for manipulating train 102 along route 106. In some examples, driving strategy module 138 receives updated set of locomotives 182 and factors the identification of activated or deactivated locomotives within consist 118 in the current and forthcoming operation of train 102 into the driving strategy to be employed. For instance, if two of the three addressable locomotives 114 are deemed by consist management module 136 to be in isolation mode, driving strategy module 138 will generate an appropriate driving strategy based on the engagement of only one of the addressable locomotives 114. In this way, the calculation of relative benefit between different schemes for consist 118 and the determination of which locomotives to activate or deactivate may be handled outside driving strategy module 138, freeing that module to focus on driving strategies. Accordingly, further complication of the machine-learning in driving strategy module 138 required for controlling train 102 can be avoided and concentrated within prediction module 134 and consist management module 136.

Finally, as shown in FIG. 1A, control system 122 includes a locomotive control module 140) configured to implement decisions and commands from energy-management system 130 on the locomotives within consist 118. In some examples, control system 122 can receive instructions from energy-management system 130 and implement one or more of throttle requests, dynamic braking requests, and pneumatic braking requests for locomotives within consist 118. Typically, control system 122 within lead locomotive 110 receives and processes the instructions for manual or automatic execution. For instance, for manual execution, the instructions may be displayed to a locomotive operator via a display on a control panel, which the operator may use to manually control throttle, braking, and or other controls to implement the driving strategy determined by energy-management system 130. For automatic execution, the instructions generated by driving strategy module 138 may be used by lead locomotive 110 for automatically actuating throttle, braking, and/or other controls of lead locomotive 110 and the trailing locomotives within consist 118, according to the driving strategy associated with energy-management system 130.

Figure 3:
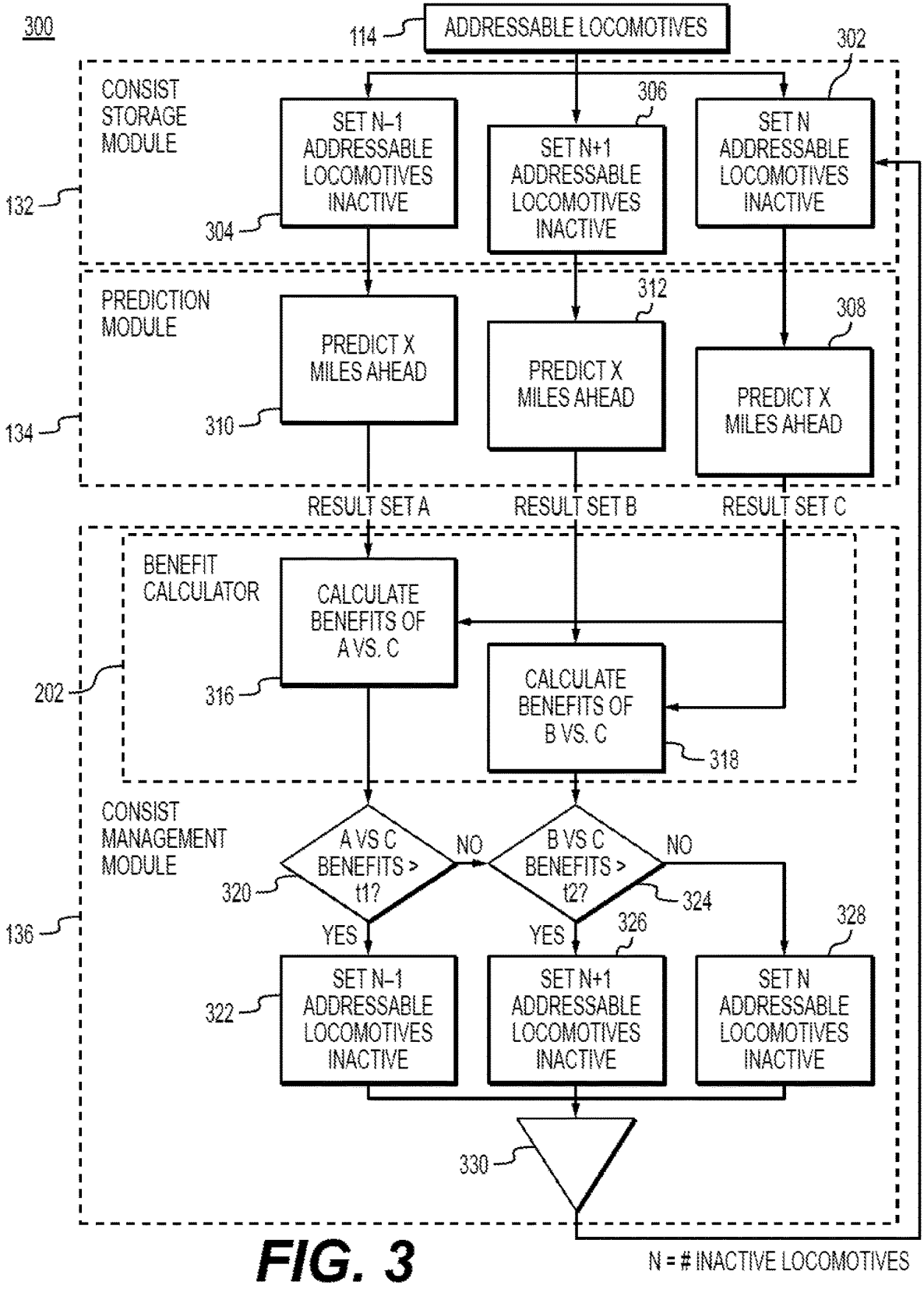
FIG. 3 is a flow diagram depicting a method of selectively deploying locomotives in a consist in accordance with an example of the present disclosure.

Turning from the structure and organization of train 102 to a method involving those structures, FIG. 3 is a flow diagram of a representative method for deploying locomotives within consist 118. This method 300 is illustrated as a logical flow graph, operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described operations may be combined in any order and/or in parallel to implement the process.

As reflected in FIG. 3, method 300 may begin with consist storage module 132 detecting or otherwise identifying addressable locomotives 114 within consist 118 of train 102. The addressable locomotives depend largely on control system 122 within each of the locomotives and whether the control electronics have a configuration enabling direct and unique addressing and communication by lead locomotive 110. Protocols such as ICC and LCCM, for instance, may permit locomotives within consist 118 to be uniquely addressable. As part of this process, consist storage module 132 may retrieve the addressable locomotives 114 from an ICC router, for example, or may have the identification of addressable locomotives 114 previously stored within consist storage module 132 as part of energy-management system 130.

In a second step 302 within method 300, consist storage module 132 sets, or stores in a memory, a number N and/or an identification of addressable locomotives 114 to be inactive. In some examples, N corresponds to the number of addressable locomotives currently inactive in consist 118 when method 300 begins. In other examples, consist storage module 132 may select one or more of addressable locomotives 114 to be inactive to begin the method, such as selecting in memory first addressable locomotive 114A to be in an isolation state. Coincident with the action, consist storage module 132 may also set, or store in a memory, a number N−1 of addressable locomotives to be inactive. Thus, if N for step 302 had been a value of one with first addressable locomotive 114A being deactivated, then step 304 would indicate that zero (N−1) addressable locomotives would be inactive. Likewise, for step 306, consist storage module 132 also sets, or stores in a memory, a number N+1 (i.e., two) of the addressable locomotives to be inactive. For example, consist storage module 132 could identify that first addressable locomotive 114A and second addressable locomotive 114B would be selected to enter an isolation state.

Based on the setting of addressable locomotives to be placed into an isolation state in steps 302, 304, and 306, prediction module 134 of energy-management system 130 then assesses the future performance of train 102 in each of those scenarios. Thus, as shown in FIG. 3, using the assumption of N addressable locomotives as inactive in step 302, prediction module 134 in step 308 predicts the performance of train 102 at X miles ahead, i.e., at upcoming distance 108. As discussed above, prediction module 134 may consider path characteristics 160, such as the speed limit, the grade of the track, the curvature of the track, wind speed, wind direction, precipitation, emissions requirements, noise limitations, etc., and current operating parameters 162, such as fuel level, speed, engine temperature, oil pressure, emissions, power output, etc. that control system 122 obtains at least from sensors installed within train 102. In addition, prediction module 134 accesses historical data from its machine-learning engine from previous runs to evaluate how train 102 should perform at the distance X miles ahead. Similarly, prediction module 134 predicts performance for train 102 in step 310 based on N−1 locomotives being set inactive (from step 304) and in step 312 based on N+1 locomotives being set inactive (step 306).

Following the activity of prediction module 134, benefit calculator 202 within consist management module 136 calculates and evaluates benefits from each of the predictions from steps 308, 310, and 312. As indicated in FIG. 3, each of the predictions for different quantities of deactivated locomotives is contained in a respective result set generated by prediction module 134. Thus, step 308 generates a result set C of expected operational parameters with N addressable locomotives being inactive at X miles ahead, from which benefit calculator 202 can process one or more benefits. Similarly, benefit calculator 202 can generate benefits from a result set B provided by step 312, and benefits from a result set A provided by step 310 by prediction module 134.

As generally discussed above with respect to FIG. 2, benefit calculator 202 can identify one or more benefits for each of the respective sets of inactive locomotives such that they can be compared with each other. In step 316, benefit calculator 202 calculates and compares the benefits of result set A (N−1 locomotives inactive) with the benefits flowing from result set C (N locomotives inactive). In step 318, benefit calculator 202 also determines common benefits and compares them between result set B (N+1 locomotives inactive) with result set C (N locomotives inactive). The precise calculation and comparison indicated in FIG. 3 is not limiting of the present disclosure, and other combinations and comparisons between result sets will be apparent to those of ordinary skill in the field from this disclosure.

In comparing the benefits flowing from the different result sets, consist management module 136 determines the most advantageous deployment of locomotives for propelling the train X miles ahead, i.e., across upcoming distance 108. In step 320, consist management module 136 evaluates whether the benefits from result set A are better than the benefits from result set C. In addition, as shown in FIG. 3, step 320 may include assessing whether the benefits from result set A exceed the benefits from result set C by a predetermined threshold T1. Threshold T1 can help establish a form of hysteresis and prevent consist management module 136 from causing a change to the deployed locomotives too frequently. Thus, if the benefits from result set A exceed the benefits from result set C by the threshold T1, consist management module 136 will conclude that the N locomotives currently set as being inactive should be changed to N−1 locomotives (result set A) at step 322. If at step 320, consist management module 136 determines that the benefits from result set A do not exceed the benefits from result set C, or do not exceed above the threshold T1, then consist management module 136 will not make a change to the N locomotives currently set as being inactive.

In step 324, consist management module 136 evaluates whether the benefits from result set B (N+1 locomotives inactive) are better than the benefits from result set C by a predetermined threshold T2. Threshold T2 may be the same or different from threshold T1 and also provides a form of hysteresis in adding more locomotives to the set of inactive ones. If the benefits from result set B exceed the benefits from result set C by the threshold T2, consist management module 136 will conclude that the N locomotives currently set as being inactive should be changed to N+1 locomotives (result set B) at step 326. If at step 324, consist management module 136 determines that the benefits from result set B do not exceed the benefits from result set C, or do not exceed above the threshold T2, then consist management module 136 will not make a change to the N locomotives currently set as being inactive (step 328).

In step 330, consist management module 136 will select or otherwise pass the setting for inactive locomotives determined by one of steps 322, 326, and 328. This setting will become the value of N for recurring method 300. If result set C indicates the highest benefit for train 102, then the value of N will remain unchanged from what it had been within step 308. If consist management module 136 determines that result set A (steps 320 and 322) or result set B (steps 324 and 326) provides superior benefits X miles ahead, then a new value (either N−1 or N+1) will become the new value for N. As shown in FIG. 3, this new value for N is returned to step 302 within consist storage module 132, where method 300 may continue in a new cycle.

In addition to returning to consist storage module 132, the new value of N and any characteristic data of those N inactive locomotives may also be passed to driving strategy module 138. Driving strategy module 138 can then process its throttle algorithm and other controls for consist 118 based on the number of locomotives available for providing tractive effort as determined by FIG. 3. Consequently, the determination of an optimal and efficient number and selection of active locomotives for deployment is largely conducted by prediction module 134 and consist management module 136, and the machine-learning system of driving strategy module 138 is not burdened with having to evaluate different deployment schemes for the locomotives while also determining throttle, braking, and other variables.

Figure 4:
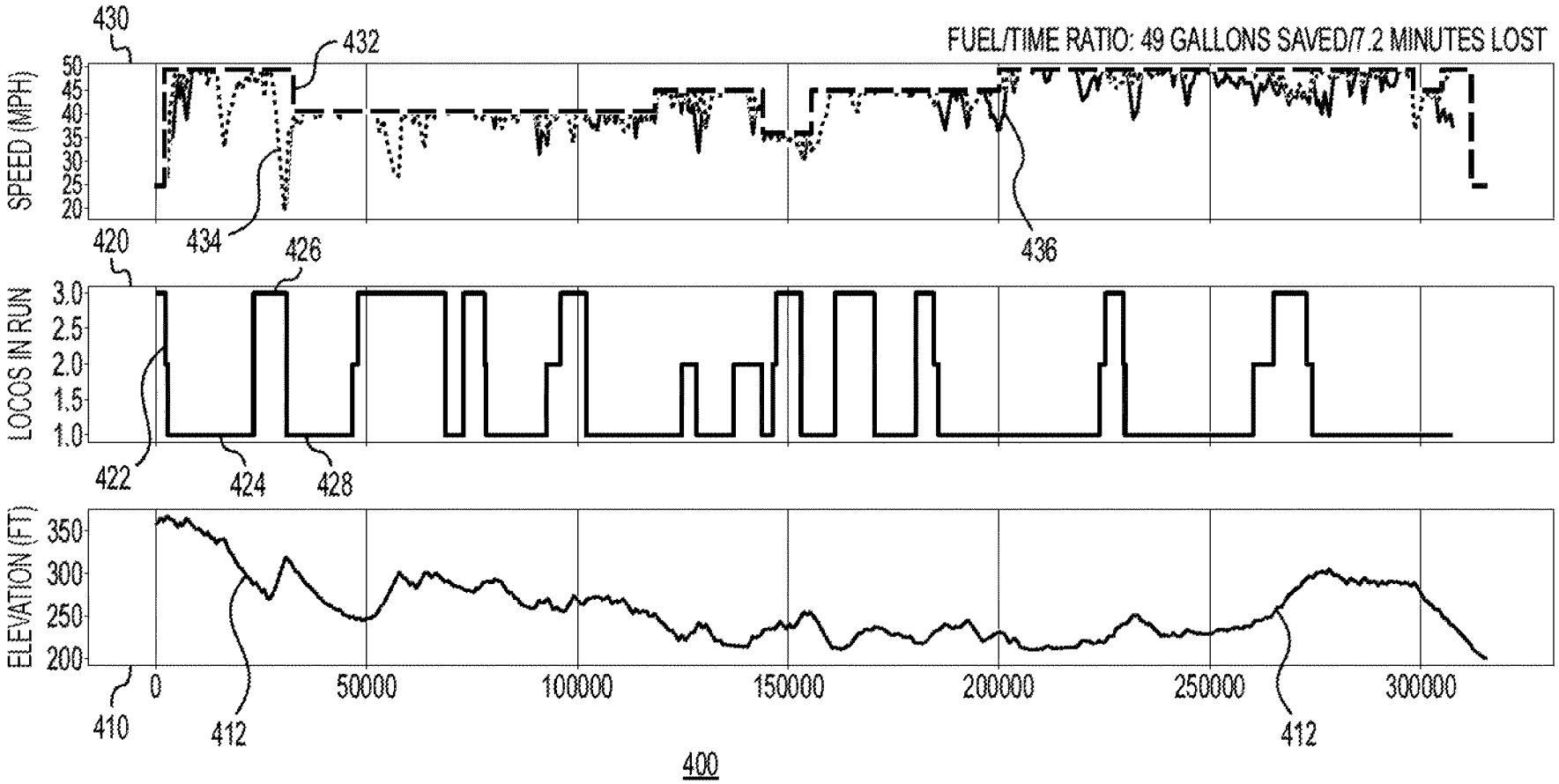
FIG. 4 is a group of graphs depicting results of a simulation involving selective deployment of locomotives in a consist in accordance with an example of the present disclosure.

FIG. 4 is a group of graphs depicting results of a simulation involving selective deployment of locomotives in a consist in accordance with method 300. FIG. 4 includes an elevation plot 410, an activated locomotives graph 420, and a simulated results 430. In elevation plot 410, 412 depicts the elevation of a path for a train, such as route 106 for train 102, over a distance of several hundred kilometers. In simulated results 430, a speed limit 432 across the path is indicated on the graph, which shows speed versus distance. As the simulated train traverses the path, method 300 evaluates predicted parameters for the train and corresponding benefits when different numbers of locomotives within consist 118 placed in an inactive state.

As shown in activated locomotives graph 420, consist management module 136 selectively determines that different numbers of locomotives may be employed over the course of the journey to provide most efficient operation. Specifically, the plot of activated engines 422 depicts a quantity of addressable locomotives activated during the run, between 1.0 and 3.0. Slightly after the beginning of the simulation, consist management module 136 determines at first location 424 that 1.0 locomotives are most efficient for passing over the downward elevation shown in elevation plot 410 while most closely meeting the speed limit 432 correspondingly shown in simulated results 430. Perhaps due to an increase in grade shown in elevation plot 410, consist management module 136 next concludes that an increased number of active locomotives to 3.0 would be required to achieve the greatest benefit at second location 426 in activated locomotives graph 420. As the elevation in elevation plot 410 then again slopes downwardly, the number of active locomotives in the run determined by consist management module 136 is decreased to 1.0 at third location 428. Similar changes to the number of locomotives during the run can be traced by comparing elevation plot 410, activated locomotives graph 420, and simulated results 430.

The graph of simulated results 430 depicts differences in speed and ultimate performance attained under the simulation. The plot of all-activated speed 434 shows speed for simulated train 102 with all available locomotives being activated, while the plot of partial-deactivated speed 436 shows the speed across the run with some of the locomotives being deactivated as indicated by activated locomotives graph 420. The top of the simulated results 430 summarizes the performance advantages that the simulation concluded when employing method 300. Specifically, the run saved 49 gallons of fuel while 7.2 minutes of travel time were lost due to the intermittent decrease in active locomotives.

Those of ordinary skill in the field will appreciate that the principles of this disclosure are not limited to the specific examples discussed or illustrated in the figures. For example, while the system and method has been discussed in the context of changing a consist by activating or deactivating one locomotive, other sequences of analyzing change to the consist are feasible and could be implemented. Moreover, the process of comparing benefits between groups of locomotives may also take into account specific characteristics of each locomotive and consider the value of activating or deactivating each locomotive individually.

INDUSTRIAL APPLICABILITY

The present disclosure provides systems and methods to assess in real time the operating parameters of a train and characteristics of a route for the train using machine-learning algorithms. A consist management module within the energy-management system evaluates predictions of future performance by the train when different numbers of locomotives within a consist are inactive. The consist management module calculates and compares operating benefits of the train derived from the predictions with respect to travel across an upcoming distance and identifies a number of locomotives to place in an isolation mode to provide efficient operation of the train. The number identified is provided to a driving strategy module for consideration in maneuvering the train over the upcoming distance.

As noted above with respect to FIGS. 1A, 1B, and 2-4, an example method for deploying locomotives within a consist 118 of a train 102 includes receiving by an energy-management system 130, during movement of the train along a path, current operating parameters 162 of the train and path characteristics 160 across an upcoming distance 108, and predicting, based at least in part on the current operating parameters and the characteristics, baseline metrics 170 for operation of the train across the upcoming distance under a baseline condition that a baseline set of locomotives 164 will be deployed. The method also entails predicting in real time, based at least in part on the current operating parameters and the characteristics, first metrics 172 for operation of the train across upcoming distance 108 under a first condition that first set of locomotives 166 will be deployed. From those predictions, a consist management module 136 calculates a baseline benefit 176 from baseline metrics 170 using a benefit calculator and a first benefit 178 from first metrics 172. Comparing these benefits for relative advantages of efficiency, consist management module 136 can select a set of locomotives to deploy in consist 118 to achieve the greatest benefit and efficient operation of train 102 over upcoming distance 108.

In the examples of the present disclosure, the energy-management system using real-time analysis with a machine-learning engine can effectively determine the proper amount of tractive effort to apply for a given situation as the train moves continuously along a route 106. As such, the train need not rely on a predetermined plan for adjusting activation of locomotives during a mission in case situations arise during the mission that deviate from the plan. Instead, the reaction of the energy-management system a posteriori to situations along upcoming distance 108 considering current operating parameters of the train, characteristics of the path, and historical data of previous runs from which the machine-learning engine has been trained can yield more nimble reactions to changes along the route. As a result, train 102 can run more efficiently, minimizing fuel consumption, exhaust emissions, and noise, as desired, without losing significant travel time for the mission.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A: B; C: A and B: A and C: B and C: A, B, and C; or multiple of any item such as A and A: B, B, and C: A, A, B, C, and C: etc.

Terms of approximation are meant to include ranges of values that do not change the function or result of the disclosed structure or process. For instance, the term "about" generally refers to a range of numeric values that one of skill in the art would consider equivalent to the recited numeric value or having the same function or result. Similarly, the antecedent "substantially" means largely, but not wholly, the same form, manner or degree, and the particular element will have a range of configurations as a person of ordinary skill in the art would consider as having the same function or result.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A computer-implemented method, comprising:

identifying addressable locomotives within a consist of a train, the addressable locomotives being individually addressable by a control system on the train;

receiving, during movement of the train along a path, current operating parameters of the train and characteristics of the path across an upcoming distance;

predicting, based at least in part on the current operating parameters and the characteristics, baseline operational metrics for the train across the upcoming distance under a baseline condition, the baseline condition being a baseline set of the addressable locomotives will be deployed;

predicting in real time, based at least in part on the current operating parameters and the characteristics, first operational metrics for the train across the upcoming distance under a first condition, the first condition being a first set of the addressable locomotives will be deployed;

calculating a baseline benefit from the baseline operational metrics;

calculating a first benefit from the first operational metrics, wherein calculating the baseline benefit and calculating the first benefit comprise identifying an operational metric for the train across the upcoming distance comprising at least one of fuel used, emissions released, or total energy consumed;

comparing the baseline benefit with the first benefit;

when the first benefit exceeds the baseline benefit, selecting the first set of addressable locomotives as an updated set of addressable locomotives; and causing the updated set of addressable locomotives to be deployed for the train.

2. The computer-implemented method of claim 1, wherein causing the updated set of addressable locomotives to be deployed comprises deactivating a first of the addressable locomotives in the baseline set.

3. The computer-implemented method of claim 2, further comprising:

predicting in real time, based at least in part on the current operating parameters and the characteristics, second operational metrics for the train across the upcoming distance under a second condition, the second condition being a second set of the addressable locomotives will be deployed;

calculating a second benefit from the second operational metrics;

comparing the baseline benefit with the second benefit; and when the second benefit exceeds the baseline benefit, selecting the second set of addressable locomotives as the updated set of addressable locomotives.

4. The computer-implemented method of claim 1, wherein causing the updated set of addressable locomotives to be deployed comprises activating a second of the addressable locomotives in the baseline set.

5. The computer-implemented method of claim 2, wherein deactivating the first of the addressable locomotives comprises sending instructions to the first of the addressable locomotives to operate in isolation mode or idle mode.

6. The computer-implemented method of claim 1, further comprising providing identification of the updated set of addressable locomotives to a driving strategy module within the control system, the driving strategy module determining driving behavior for the train over the upcoming distance based on the updated set of addressable locomotives being deployed.

7. The computer-implemented method of claim 1, wherein calculating a baseline benefit and calculating a first benefit comprise identifying a ratio of operational metrics for the train across the upcoming distance.

8. The computer-implemented method of claim 7, wherein the ratio of operational metrics is at least one of (fuel used)/(time lost), (train speed)/(speed limit), (motive force available)/(motive force required), or (emissions released)/(time lost).

9. A control system for a consist of locomotives, comprising:

a consist storage module configured to store status data regarding the locomotives, the status data indicating availability of the locomotives for providing motive force along a route;

a prediction module configured to:

predict in real time, based at least in part on current operating parameters of a train moving along a path and characteristics of the path across an upcoming distance, baseline operational metrics expected for the train across the upcoming distance under a baseline condition, the baseline condition being that a group of the locomotives will be deployed, and predict in real time, based at least in part on the current operating parameters and the characteristics, alternate operational metrics expected for the train across the upcoming distance under an alternate condition, the alternate condition being that a subset of the group of the locomotives will be deployed;

a consist management module configured to:

calculate a baseline benefit from the baseline operational metrics, calculate an alternate benefit from the alternate operational metrics, wherein calculating the baseline benefit and calculating the alternate benefit comprise identifying an operational metric for the train across the upcoming distance comprising at least one of fuel used, emissions released, or total energy consumed, compare the baseline benefit with the alternate benefit, when the alternate benefit exceeds the baseline benefit, assign the subset of the group of the locomotives as an updated assignment of the locomotives, and cause the updated assignment of the locomotives to be deployed for the train; and a driving strategy module configured to:

determine a strategy for controlling movement of the train over the path using the updated assignment of the locomotives.

10. The control system of claim 9, wherein the consist management module is further configured to cause the updated assignment of the locomotives to be deployed for the train by communicating instructions to a locomotive control system for one of the locomotives in the group of the locomotives to operate in an isolation mode.

11. The control system of claim 9, wherein the prediction module is further configured to:

predict in real time, based at least in part on the current operating parameters and the characteristics, additional operational metrics for the train across the upcoming distance under an additional condition, the additional condition being that a superset of the group of the locomotives will be deployed; and wherein the consist management module is further configured to:

calculate an additional benefit from the additional operational metrics, compare the baseline benefit with the additional benefit, and when the additional benefit exceeds the baseline benefit, assign the superset of the group of the locomotives as the updated assignment of the locomotives.

12. The control system of claim 9, wherein the consist storage module is further configured to update the status data in response to the updated assignment of the locomotives.

13. The control system of claim 9, wherein calculating the baseline benefit and calculating the alternate benefit comprise identifying a ratio of operational metrics for the train across the upcoming distance.

14. A consist of locomotives for a train, comprising:

a lead locomotive containing, at least in part, a control system for the train;

a first locomotive individually addressable by the control system via a communication network;

a second locomotive individually addressable by the control system via the communication network; and an energy-management system, at least partially contained within control system, the energy-management system configured to:

receive, during movement of the train along a path, current operating parameters of the train and characteristics of the path across an upcoming distance, predict in real time, based at least in part on the current operating parameters and the characteristics, baseline operational metrics for the train across the upcoming distance under a baseline condition that the first locomotive and the second locomotive will be deployed, predict in real time, based at least in part on the current operating parameters and the characteristics, alternate operational metrics for the train across the upcoming distance under an alternate condition that the first locomotive will be deployed and the second locomotive will not be deployed, calculate a baseline benefit from the baseline operational metrics, calculate an alternate benefit from the alternate operational metrics, wherein calculating the baseline benefit and calculating the alternate benefit are based, at least in part, on an operational metric for the train across the upcoming distance, the operation metric being one or more of fuel used, emissions released, or total energy consumed, compare the baseline benefit with the alternate benefit, and when the alternate benefit exceeds the baseline benefit, assign the baseline set without the second locomotive as an updated set of the locomotives; and a locomotive control system, within at least the second locomotive, configured to cause the second locomotive to operate in an isolation mode in response to the assignment of the updated set by the energy-management system.

15. The consist of claim 14, wherein the energy-management system is further configured to:

store status data regarding the first locomotive and the second locomotive, the status data indicating availability of the first locomotive and the second locomotive for providing motive force along the path.

16. The consist of claim 14, wherein the energy-management system is further configured to:

determine a strategy for controlling movement of the train over the path using the updated set of the locomotives and communicating instructions according to the strategy to at least a locomotive control system.

17. The consist of claim 14, further comprising:

at least one additional locomotive in the train, the at least one additional locomotive not being individually addressable by the control system.

18. The computer-implemented method of claim 1, wherein the baseline benefit and the first benefit are at least one of fuel savings, decreased emissions, or lower noise.

19. The control system of claim 9, wherein the baseline benefit and the alternate benefit are at least one of fuel savings, decreased emissions, or lower noise.

20. The consist of claim 14, wherein the baseline benefit and the alternate benefit are at least one of fuel savings, decreased emissions, or lower noise.

* * * * *